US006986215B2

(12) United States Patent
Moretti

(10) Patent No.: US 6,986,215 B2
(45) Date of Patent: Jan. 17, 2006

(54) WATERPROOFED BREATHABLE SOLE FOR SHOES AND METHOD FOR THE MANUFACTURE THEREOF

(75) Inventor: Mario Polegato Moretti, Crocetta del Montello (IT)

(73) Assignee: Geox S.p.A., Montebelluna (IT)

( * ) Notice: Subject to any disclaimer, the term of this patent is extended or adjusted under 35 U.S.C. 154(b) by 55 days.

(21) Appl. No.: 10/250,700

(22) PCT Filed: Dec. 27, 2001

(86) PCT No.: PCT/EP01/15327

§ 371 (c)(1),
(2), (4) Date: Jul. 7, 2003

(87) PCT Pub. No.: WO02/052970

PCT Pub. Date: Jul. 11, 2002

(65) Prior Publication Data

US 2004/0045189 A1 Mar. 11, 2004

(30) Foreign Application Priority Data

Jan. 5, 2001 (IT) ..... PD2001A0001

(51) Int. Cl.
*A43B 13/18* (2006.01)

(52) U.S. Cl. ..... 36/3 B; 36/25 R

(58) Field of Classification Search ..... 36/3 B, 36/12, 25 R, 14, 55
See application file for complete search history.

(56) References Cited

U.S. PATENT DOCUMENTS

| | | | | | |
|---|---|---|---|---|---|
| 4,925,732 | A | * | 5/1990 | Driskill et al. | 428/336 |
| 5,588,226 | A | | 12/1996 | Schenkel | |
| 5,598,644 | A | * | 2/1997 | Polegato | 36/3 B |
| 5,732,479 | A | | 3/1998 | Pavelescu | |
| 5,983,524 | A | * | 11/1999 | Polegato | 36/3 R |
| 2001/0023023 | A1 | | 9/2001 | Morlacchi | |

FOREIGN PATENT DOCUMENTS

| | | | |
|---|---|---|---|
| DE | 299 22 076 | | 4/2000 |
| DE | 29922076 | * | 5/2000 |
| EP | 0 619 959 | | 10/1994 |
| EP | 0910964 A2 | * | 4/1999 |
| GB | 2 290 455 | | 1/1996 |
| WO | WO98/51177 | * | 11/1998 |

* cited by examiner

*Primary Examiner*—Ted Kavanaugh
(74) *Attorney, Agent, or Firm*—Oblon, Spivak, McClelland, Maier & Neustadt, P.C.

(57) ABSTRACT

A waterproofed and breathable sole for shoes, which includes a tread made of leather, or similar breathable and water-permeable material, at least partially covered in an upward region by a membrane made of a material that is breathable and impermeable to water and is perimetrically joined to the tread with the interposition of a sealant or by direct adhesion thereof so as to provide a seal.

16 Claims, 2 Drawing Sheets

WATERPROOFED BREATHABLE SOLE FOR SHOES AND METHOD FOR THE MANUFACTURE THEREOF

TECHNICAL FIELD

The present invention relates to a waterproofed breathable sole for shoes and to the method for the manufacture thereof.

BACKGROUND ART

It is known that the main problem encountered in using shoes with an ordinary sole made of natural material, such as leather or equivalents, is constituted by wet conditions.

When rain and bad weather cause roads to become wet and slippery, it is not advisable to use shoes with leather soles, since leather, indeed because of its characteristic of being breathable and healthy for the foot, is not impermeable but on the contrary absorbs water.

The thinner the leather, the faster it becomes impregnated with water or moisture until the user's foot becomes wet.

This drawback is aggravated by the fact that the leather tread is not engraved and is smooth or even often polished with polishes.

This constitutes an additional problem with wet weather, since in these conditions grip is unsteady.

Accordingly, the use of shoes with a leather tread is constrained by weather conditions and therefore shoes with this type of material are mainly provided by manufacturers in summer collections in countries where the dry season lasts longer.

In order to obviate this drawback, the sole according to EP-0 619 959 has been devised: such sole comprises a tread made of leather or similar material, covered in an upward region by a membrane made of a material that is breathable and waterproof (fixed by spot gluing) and is assembled together with an upper part made of rubber or equivalent material (so as to provide a seal at the edge of the membrane) and has, at least in the regions affected by such membrane, one or more through holes.

Although it constitutes a considerable technological step forward that has allowed its unquestionable commercial success, in turn, the above described sole has been found to have drawbacks, such as high manufacturing costs owing to the need for templates and/or molds for cutting the membranes and for forming the perimetric seal.

Furthermore, the thicknesses produced by the presence of the upper layer with the tread increase the rigidity of the sole, and therefore some types of shoes that require high flexibility, such as women's shoes, encounter manufacturing difficulties.

Furthermore, the manufacturing system is scarcely flexible owing to the many operations required to achieve the finished product.

Another problem is the possibility that the membrane may delaminate from the sole, triggering abrasion phenomena with consequent loss of waterproofing.

DISCLOSURE OF THE INVENTION

The aim of the present invention is to provide a sole and a method for the manufacture thereof that solve the drawbacks noted above in known types of waterproofed and breathable shoes with leather tread.

A consequent primary object is to provide a sole that can be thin and flexible.

Another object is to increase breathability.

Another important object is to provide a sole in which the danger of abrasion of the membrane is eliminated.

Another object is to increase user comfort.

Another object is to provide a sole that can be manufactured at low cost and therefore can be sold at a competitive price.

Another object is to provide a sole that can be manufactured with known equipment and techniques.

This aim and these and other objects that will become better apparent hereinafter are achieved by a waterproofed and breathable sole for shoes, characterized in that it comprises a tread made of leather, or similar breathable and water-permeable material, which is at least partially covered in an upward region by a membrane made of a material that is breathable and impermeable to water and is perimetrically joined to the tread with the interposition of a sealant or by direct adhesion thereof so as to provide a seal.

BRIEF DESCRIPTION OF THE DRAWINGS

Further characteristics and advantages of the sole according to the invention will become better apparent from the detailed description of some embodiments thereof, illustrated only by way of non-limitative example in the accompanying drawings, wherein.

WAYS TO CARRYING OUT THE INVENTION

Figure 1:
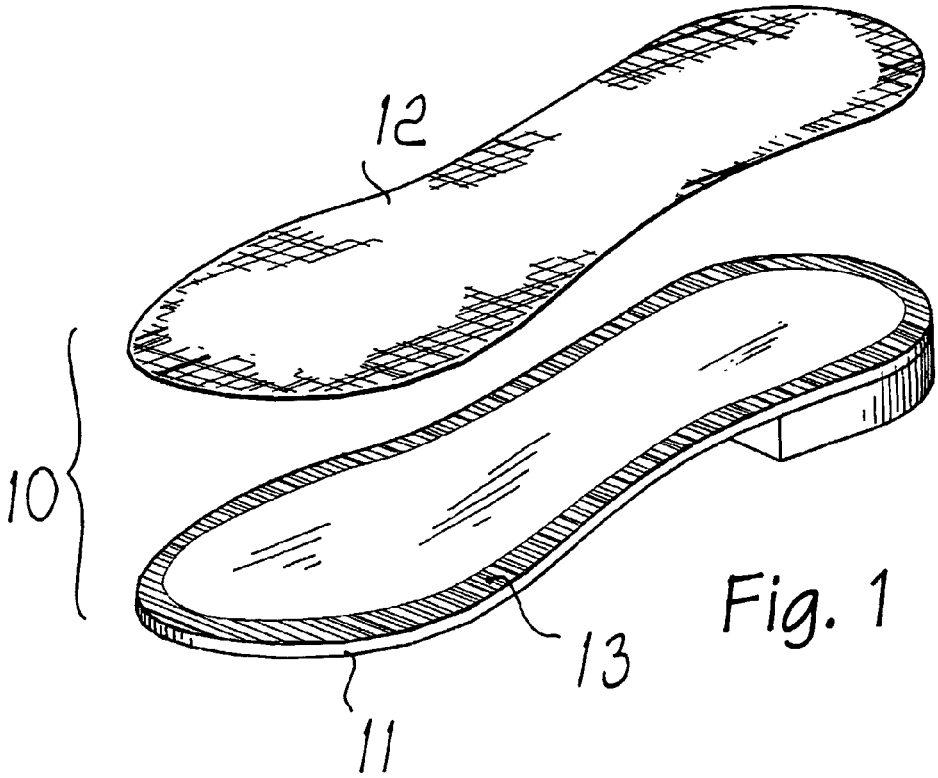
FIG. 1 is an exploded perspective view of the components of a first embodiment of the sole according to the invention.
Figure 2:
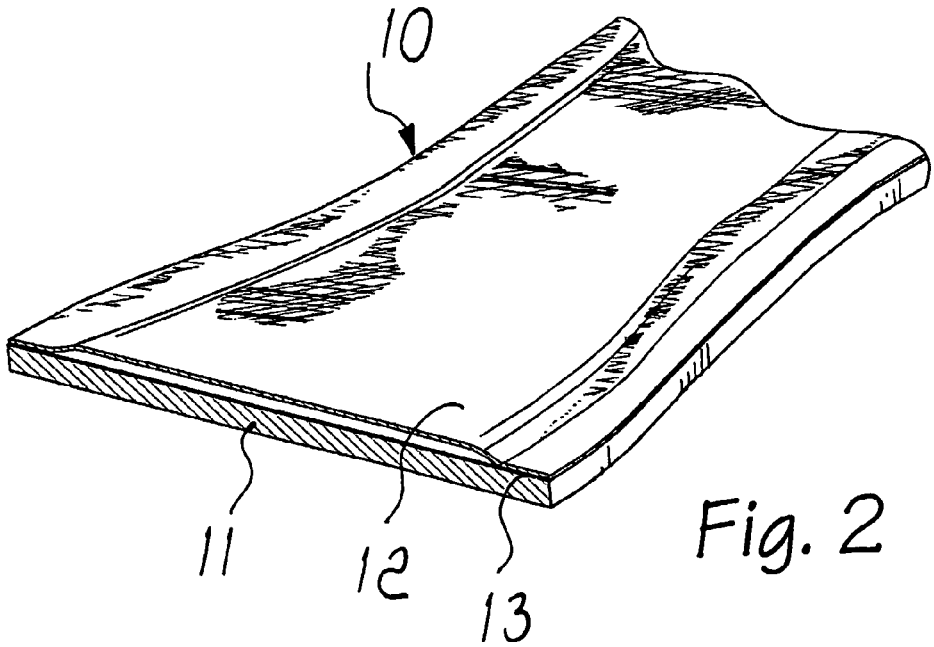
FIG. 2 is a perspective view of the sole of FIG. 1, shown assembled and with the internal part of the membrane raised so as to graphically point out the peripheral sealing regions.

With reference to FIGS. 1 and 2, a first embodiment of the waterproofed breathable sole for shoes is generally designated by reference numeral 10 and comprises a tread 11, made of leather or similar breathable and water-permeable material (such as leather, open-cell synthetic material, et cetera), which is covered in the upper part, substantially in the plantar region, by a membrane 12, which is impermeable to water and vapor-permeable (breathable) and is preferably made of expanded polytetrafluoroethylene (PTFE) or of a hydrophilic polymer, such as polyurethane.

In particular, hydrophilic polymers are breathable owing to the presence, on their molecular chains, of functional groups capable of capturing the water molecule and of conveying it along their structure.

The membrane 12, which in this case preferably is devoid of any support, is provided with thicknesses that can vary between 5 and 40 microns.

The membrane is conveniently perimetrically spaced from the edge of the tread 11 (although it can be shaped complementarily to the edge of the tread 11) and forms a monolithic body with it by being joined thereto by means of suitable sealants, such as adhesives 13, which are for example spread perimetrically thereon.

Suitable adhesives can be constituted by hydrophilic polyurethane prepolymers in the semiliquid state or in solutions of organic solvents for a dry content of approximately 50% by weight.

It is possible to use, for example, a product of the Belgian company UCB S.A. known under the trade-name UCECOAT TD 9627/E.

The adhesives may also be conventional polyurethane adhesives or adhesives that are compatible with adhesion both with the membrane 12 and with the tread 11.

In practice, the adhesive 13 is spread on the upper part of the tread 11 (with the appropriate addition of catalysts, if necessary, such as isocyanates or amine compounds) at least at the region of the edge of the membrane 12.

The hydrophilic polyurethane prepolymer is breathable, and therefore it might be spread over the entire region of the membrane 12.

Otherwise, when non breathable adhesive are used it is necessary to perform continuous perimetric spreading and internal spot spreading or deposition (on the membrane 12). Obviously breathable adhesives may also be used for spot deposition. A continuous internal spreading may instead be carried out if powdered adhesives (with a polyurethane base or of the heat-reactive type), which do not inhibit breathability, are used in the internal regions.

The membrane 12 is applied while the adhesive 13 is still moist.

The prepolymer polymerization reaction is facilitated by the high temperatures (approximately 150° for 30 seconds), which can be lowered by adding reaction promoters.

In 24 hours, the polymerization reaction can be considered complete and the sole 10 becomes a finished product.

It can be advisable to perform compression of the membrane 12 onto the tread 11 in order to improve coupling.

The addition of the catalyst and of the promoter also serves to improve resistance to hydrolysis and aging.

Wet application is designed to allow wetting of the membrane 12 as well, so as to obtain optimum hermetic gluing.

It is also possible to provide cold gluing, by using adhesives that do not require catalysis, and final compression.

The membrane 12 constitutes a barrier to water and moisture but preserves the breathability characteristics given to the sole by the presence of the leather tread 11.

Figure 3:
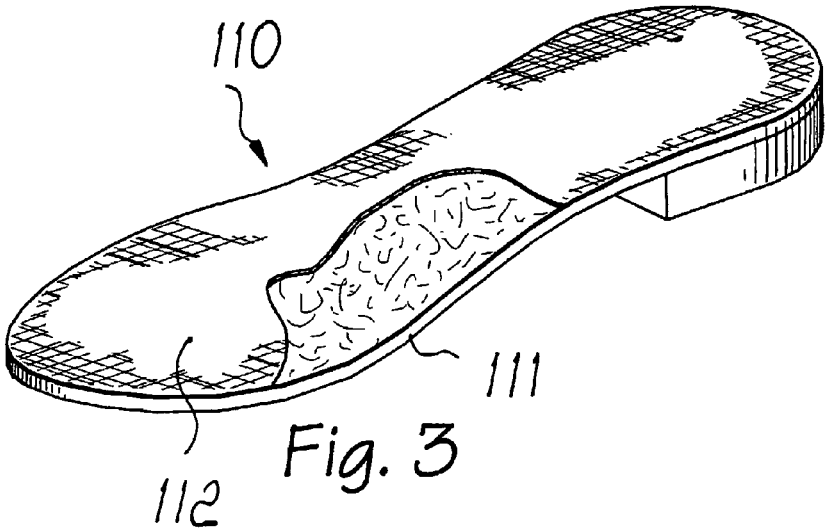
FIG. 3 is a perspective view of the assembled sole in a second embodiment.
Figure 4:
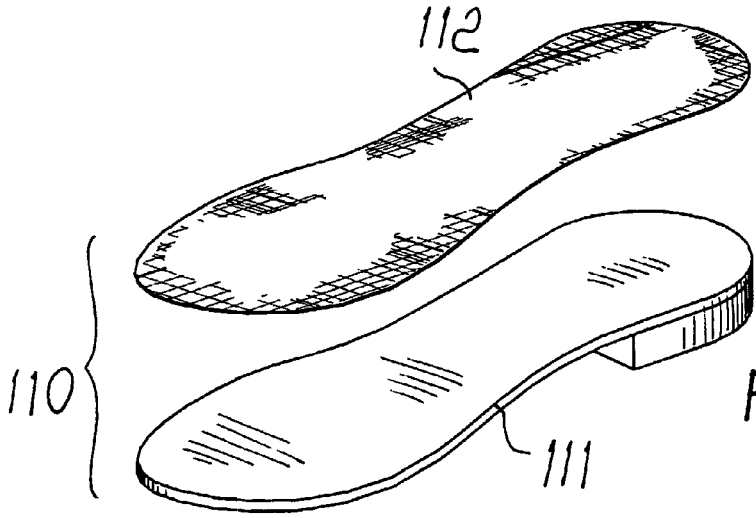
FIG. 4 is an exploded perspective view of the components of the second embodiment of the sole according to the invention.
Figure 5:
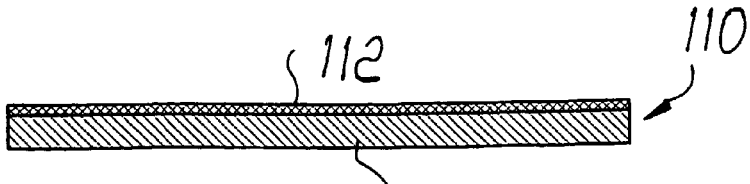
FIG. 5 is a sectional view of the sole of FIG. 3.

With reference now to the FIGS. 3 to 5, a second embodiment of the waterproofed and breathable sole for shoes is generally designated by reference numeral 110 and comprises a tread 111 made of leather or similar material which is covered in the upper part, substantially in the plantar region, by a membrane 112, which is impermeable to water and permeable to vapor (breathable) and is preferably produced directly on the tread 111 itself by spreading a hydrophilic polymer, such polyurethane.

As mentioned, hydrophilic polymers are vapor-permeable due to the presence, on the molecular chains, of functional groups capable of capturing the water molecule and of conveying it along their structure.

The membrane 112, which is devoid of any support, is provided with thicknesses that can vary between 5 and 40 microns, preferably 20 microns.

The membrane 112 becomes monolithic with the tread 111.

Hydrophilic polyurethanes in the semiliquid state or in solutions of organic solvents, for a dry content of approximately 50% by weight, can be suitable in order to provide the membrane 112.

It is possible to use, for example, the product of the Belgian company UCB S.A. known under the trade-name UCECOAT TD 9627/E.

In practice, the prepolymer is spread onto the upper part of the tread 111, for example by means of a brush, a doctor blade, a roller, or by spraying (appropriately with the addition of catalysts such as isocyanates or amine compounds).

The polymerization reaction of the prepolymer is facilitated by high temperatures (approximately 150° for 30 seconds), which can be reduced by adding reaction promoters.

In 24 hours, the polymerization reaction can be considered complete and the sole 110 becomes a finished product.

The layer of polymer that has been formed constitutes the membrane 112, which is self-sealed onto the tread 111.

The addition of the catalyst and of the promoter also serves to improve resistance to hydrolysis and aging.

In practice it has been found that the intended aim and objects of the present invention have been achieved.

The sole in fact has the qualitative characteristics of leather soles, particularly regarding breathability, with the qualitative characteristics of soles made of rubber or synthetic material, particularly waterproofness, and with reduced thicknesses owing to the absence of the perimetric plastic element that is required in current ones in order to provide a perimetric seal.

It should be noted that sole according to the invention can be produced without particular difficulties with a manufacturing process that is operatively more flexible than the current one owing to the lack of templates and/or die-cutters.

Breathability is increased, especially in extremely humid conditions, with respect to what can be obtained with current waterproofed leather soles, by increasing the surface available for breathing (the perimetric seal has been removed, and in some cases spot gluing is also eliminated).

Furthermore, any danger of abrasion of the membrane has been eliminated.

The invention thus conceived is susceptible of numerous modifications and variations, all of which are within the scope of the appended claims.

All the details may further be replaced with other technically equivalent elements.

In practice, the materials used, so long as they are compatible with the contingent use, as well as the dimensions, may be any according to requirements.

The disclosures in Italian Patent Application No. PD2001A000001 from which this application claims priority are incorporated herein by reference.

What is claimed is:

1. A waterproofed and breathable sole for shoes, comprising:

a tread made of leather, or similar breathable and water-permeable material, which is entirely covered in an upward region by a membrane made of a material that is breathable and impermeable to water and is joined at least perimetrically to the tread with the interposition of a sealant, said membrane being shaped perimetrically complementarily to the edge of said tread such that said membrane and said tread have the same perimetric dimensions.

2. The sole according to claim 1, wherein said waterproof breathable membrane is made of expanded polytetrafluoroethylene.

3. The sole according to claim 1, wherein said waterproof breathable membrane is devoid of any support and is provided with a thicknesses between 5 and 40 microns.

4. The sole according to claim 1, wherein said membrane is monolithic with said tread and is joined to said thread through said sealant wherein said sealant comprises an adhesive spread on the tread perimetrically.

5. The sole according to claim 4, wherein said adhesive is at least one hydrophilic polyurethane prepolymer in semi-liquid state or in solutions in organic solvents for a dry content of approximately 50% by weight.

6. The sole according to claim 4, wherein said adhesive is a conventional polyurethane adhesive that is adhesion-compatible with both said membrane and said tread.

7. The sole according to claim 1, wherein catalysts selected from the group consisting of isocyanates and amine compounds are added to said adhesive.

8. The sole according to claim 1, wherein inside the sealed region said membrane is spot-glued to said tread by adhesives that inhibit breathability.

9. The sole according to claim 1, further comprising a sealed region wherein said membrane is glued to said tread in a covering manner with adhesives that do not inhibit breathability and which are selected from a group consisting of hydrophilic polymers.

10. A method for producing a waterproofed and breathable sole for shoes, comprising the steps of:

providing a tread made of leather, or similar breathable and a water-permeable material, providing a membrane made of a material that is breathable and impermeable to water and that is shaped perimetrically complementarily to the edge of said tread such that said membrane and said tread have the same perimetric dimensions, spreading sealant on an upper part of the tread, at least at a position of an edge of the membrane;

applying the membrane on the tread while the sealant is still moist such that the membrane entirely covers the upward region of the tread, performing catalysis selectively, either at high temperature, or at a lower temperature with addition of reaction promoters; and performing cooling.

11. The method according to claim 10, further comprising compressing said membrane on said tread.

12. The method according to claim 10, wherein the sealant is a hydrophilic polyurethane prepolymer, and spreading is performed on an entire surface region of the membrane.

13. The method for producing a sole according to claim 10, further comprising:

spreading sealant of cold-acting type on the upper part of the tread, at least at a region of the edge of the membrane; and applying the membrane while the adhesive is still moist.

14. The method according to claim 13, further comprising spot depositing, on said membrane, an adhesive that inhibits breathability in regions located within the edge sealant region before application thereof to said tread.

15. The method according to claim 13, further comprising copying a coating deposition on said tread of an adhesive that does not inhibit breathability in regions inside said sealant before said membrane is applied.

16. The method according to claim 13, further comprising compressing said membrane on said tread.

* * * * *